US008922327B2

(12) United States Patent
Inaba

(10) Patent No.: US 8,922,327 B2
(45) Date of Patent: Dec. 30, 2014

(54) REACTOR AND MANUFACTURING METHOD FOR REACTOR

(75) Inventor: Kazuhiro Inaba, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 13/814,445

(22) PCT Filed: Aug. 24, 2011

(86) PCT No.: PCT/JP2011/069025

§ 371 (c)(1),
(2), (4) Date: Feb. 5, 2013

(87) PCT Pub. No.: WO2012/035940

PCT Pub. Date: Mar. 22, 2012

(65) Prior Publication Data

US 2013/0135072 A1 May 30, 2013

(30) Foreign Application Priority Data

Sep. 13, 2010 (JP) ..... 2010-204180

(51) Int. Cl.

| | |
|---|---|
| ***H01F 27/24*** | (2006.01) |
| ***H01F 27/02*** | (2006.01) |
| ***H01F 37/00*** | (2006.01) |
| ***H01F 3/08*** | (2006.01) |
| ***H01F 27/23*** | (2006.01) |
| ***H01F 41/02*** | (2006.01) |

(52) U.S. Cl.

CPC ..... *H01F 27/02* (2013.01); *H01F 37/00* (2013.01); *H01F 27/022* (2013.01); *H01F 3/08* (2013.01); *H01F 27/23* (2013.01); *H01F 41/0246* (2013.01)

USPC ..... 336/233; 336/90; 336/212

(58) Field of Classification Search

USPC ..... 336/212, 90, 233, 221, 96

See application file for complete search history.

(56) References Cited

U.S. PATENT DOCUMENTS 3,255,512 A * 6/1966 Lochner et al. ..... 29/602.1
7,230,514 B2 * 6/2007 Brunner ..... 336/90

(Continued)

FOREIGN PATENT DOCUMENTS

JP 11-067519 A 3/1999
JP 11-067520 A 3/1999

(Continued)

OTHER PUBLICATIONS

International Search Report in PCT International Application No. PCT/JP2011/069025 dated Nov. 8, 2011.

(Continued)

*Primary Examiner* — Mangtin Lian

(74) *Attorney, Agent, or Firm* — Venable LLP; Michael A. Sartori; F. Brock Riggs

(57) ABSTRACT

A reactor 1α includes a coil 2 formed by winding a wire 2*w*, a magnetic core 3 that is disposed inside and outside of the coil 2 and forms a closed magnetic circuit, and a case 4 that has an opening portion and a bottom surface 40 that opposes the opening portion and that houses an assembly 10 of the coil 2 and the magnetic core 3. At least the opening portion of the case 4 side of the magnetic core 3 is formed of a molded solid body that contains magnetic powder and resin. A surface layer 5, which prevents the magnetic powder from rusting, is provided on a surface of the magnetic core 3 on the opening portion of the case 4 side. The surface layer 5 has a resin portion formed of resin similar to the resin contained in the magnetic core 3. The resin portion is formed so as to be continuous with the resin contained in the magnetic core 3 without an interface formed therebetween.

6 Claims, 6 Drawing Sheets

(56) References Cited

U.S. PATENT DOCUMENTS

| | | | | |
|---|---|---|---|---|
| 7,265,651 | B2 * | 9/2007 | Brunner | 336/233 |
| 7,362,201 | B2 * | 4/2008 | Saegusa et al. | 336/90 |
| 7,427,909 | B2 * | 9/2008 | Ono et al. | 336/90 |
| 2010/0245016 | A1 * | 9/2010 | Kameda et al. | 336/221 |
| 2011/0205765 | A1 * | 8/2011 | Saito et al. | 363/21.15 |

FOREIGN PATENT DOCUMENTS

| | | | |
|---|---|---|---|
| JP | 11-067522 | A | 3/1999 |
| JP | 2006-004957 | A | 1/2006 |
| JP | 2009-004670 | A | 1/2009 |
| JP | 2009-033051 | A | 2/2009 |
| JP | 2009-033057 | A | 2/2009 |
| JP | 2012-004292 | A | 1/2012 |
| WO | WO 2008/142865 | A1 * | 11/2008 |

OTHER PUBLICATIONS

Notification of Reasons for Rejection in Japanese Patent Application No. 2010-204180, dated Dec. 24, 2013.

* cited by examiner

REACTOR AND MANUFACTURING METHOD FOR REACTOR

TECHNICAL FIELD

The present invention relates to reactors used for components of power conversion devices such as on-vehicle DC-DC converters and relates to a manufacturing method for the rectors. In particular, the present invention relates to a reactor, which includes a small number of components, has a simple structure, and uses a magnetic core that is not easily degraded.

BACKGROUND ART

A reactor is one of components in a circuit that operates to increase or decrease voltage. This reactor is utilized in a converter installed in a vehicle such as a hybrid automobile. The structure of such a reactor is described, for example, in Patent Literature 1.

The reactor described in Patent Literature 1 includes a coil and a magnetic core, which is a so-called pot-type core having an E-E shaped section. The magnetic core includes an internal core portion, an external core portion, and a core coupling portion. The internal core portion is disposed at an inner periphery of the coil. The external core portion is disposed outside the coil. The core coupling portion covers ends of the coil and connects the internal core portion and the external core portion to each other. The internal core portion is formed of a compact. The external core portion and the core coupling portion are formed of a molded solid body made of resin and magnetic powder. The molded solid body can be obtained by injection molding or cast molding as follows: soft magnetic powder (such as iron powder) and binder resin (such as epoxy resin) are mixed with each other so as to create a mixed fluid, and this mixed fluid is poured into a mold so as to be molded and cured.

CITATION LIST

Patent Literature

PTL 1: Japanese Unexamined Patent Application Publication No. 2009-033051

SUMMARY OF INVENTION

The outer peripheral surface of the above-described reactor is formed of iron powder and resin contained in the molded solid body. Thus, magnetic characteristics of the magnetic core may be degraded due to corrosion of part of the iron powder caused by contact of the iron powder with air. Here, when an assembly of the coil and the magnetic core is housed in a case so as to prevent the external core portion and the core coupling portion from contacting air, corrosion of the iron powder is thought to be avoidable. However, since such a case typically has an opening portion, an anticorrosive measure for the iron powder is needed at the opening portion. Although covering the opening portion with a lid or the like, which is formed of the same material as the case, is thought to be such an anticorrosive measure, use of the lid leads to an increase in the number of components. Furthermore, even when the lid is provided on the case, it is very difficult to completely prevent the iron powder at the opening portion from contacting air. The reason of this is that designing of the lid, which can seal the opening portion of the case without a gap and does not allow a space to be formed between the lid and the magnetic core, is very difficult.

The present invention is proposed in view of the above-described situation. One of objects of the present invention is to provide a reactor that includes a small number of components, has a simple structure, and uses a magnetic core that is not easily degraded.

Another object of the present invention is to provide a manufacturing method for a reactor, in which the above-described reactor according to the present invention can be manufactured with good productivity.

Solution to Problem

The above-described objects of the present invention are achieved by providing a surface layer, which can be formed on the surface of the magnetic core at the same time as the formation of the magnetic core while the magnetic core is manufactured and contains resin similar to that of the magnetic core instead of preparing a separate covering member that corresponds to the lid independently of the case and attaching the covering member to the case.

A reactor according to the present invention includes a coil formed by winding a wire, a magnetic core that is disposed inside and outside of the coil and forms a closed magnetic circuit, and a case that has an opening portion and a bottom surface that opposes the opening portion and houses an assembly of the coil and the magnetic core. In the reactor, at least the opening portion of the case side of the magnetic core is formed of a molded solid body that contains magnetic powder and resin. Also in the reactor, a surface layer, which prevents the magnetic powder from rusting, is provided on a surface of the magnetic core on the opening portion of the case side. The surface layer has a resin portion formed of resin similar to the resin contained in the magnetic core. The resin portion is formed so as to be continuous with the resin contained in the magnetic core without an interface formed therebetween.

The reactor according to the present invention includes the surface layer that prevents the magnetic powder from rusting on the surface of the magnetic core on the opening portion of the case side. Thus, the magnetic powder can be prevented from rusting due to contact with air. Since the surface layer is formed so as to be continuous with the magnetic core without the interface formed therebetween, the surface layer is not easily separated when the surface layer is exposed to a heat cycle that occurs due to operation of the reactor. Furthermore, unlike the case where the separate covering member or the like corresponding to the lid is provided, little air remains between the covering member and the magnetic core. Thus, although the reactor according to the present invention includes the case having the opening portion, and has a structure in which the outer periphery of the coil is covered with the magnetic core, the magnetic powder does not easily corrode and magnetic characteristics of the reactor are not easily degraded.

Furthermore, the surface layer, which is formed so as to be continuous with the magnetic core without the interface formed therebetween, corresponds to a so-called sealing member that prevents the magnetic core from contacting air. Thus, there is no need of the separate covering member, and accordingly, the number of components can be reduced.

As a form of the present invention, the resin portion is formed of part of the resin contained in the magnetic core.

According to the above-described structure, need of separate preparation of resin, which is other than the resin to be contained in the molded solid body to form the resin portion, is dropped. In addition, the surface layer and the magnetic core can be in tighter contact with each other. This facilitates continuous formation of the surface layer and the magnetic core with each other without the interface formed therebetween.

As a form of the present invention, the surface layer is formed of the resin portion that does not contain the magnetic powder.

According to the above-described structure, the surface layer does not contain the magnetic powder. Thus, contact of the magnetic powder with air can be substantially avoided.

As a form of the present invention, the molded solid body covers at least part of an outer periphery of the coil, and the magnetic powder contained in the molded solid body is sparsely distributed on the opening portion of the case side and densely distributed on the bottom surface of the case side.

According to the above-described structure, the magnetic powder is sparsely distributed on the opening portion of the case side and densely distributed on the bottom surface of the case side. Thus, the resin tends to gather on the opening of the case side. That is, the amount of the magnetic powder contained in the surface layer is reduced, and in contrast, the amount of the resin contained in the surface layer is increased. This facilitates the formation of the surface layer that contains a smaller amount of the magnetic powder.

Furthermore, the magnetic powder, which has a high thermal conduction rate, tends to gather on the bottom surface side of the case. Thus, when the bottom surface of the case is on a mounting surface side of the reactor, heat generated by the coil is easily dissipated when a cooling means such as a cooling base is provided on the bottom surface side of the case.

As a form of the present invention, the magnetic core has an internal core portion inserted through the coil and a core coupling portion that covers the outer periphery of the coil and is formed of the molded solid body. The internal core portion and the core coupling portion are integrated with each other by the resin contained in the molded solid body.

According to the above-described structure, the internal core portion and the core coupling portion are integrated with each other using the resin of the molded solid body. Thus, since no adhesive is used, there is no bonding step, and the magnetic core can be formed at the same time as the formation of the core coupling portion. Furthermore, the surface layer can also be formed at the same time as the formation of the core coupling portion. Thus, the core coupling portion, the magnetic core, and the surface layer can be simultaneously formed, thereby improving productivity with which the reactor is manufactured.

In a first manufacturing method for a reactor according to the present invention, the reactor is manufactured by disposing in a case, which has an opening portion and a bottom surface that opposes the opening portion, an assembly of a coil, which is formed by winding a wire, and a magnetic core, in which the coil is disposed. The method includes the following steps.

Disposing step: The coil is disposed in the case.

Filling step: The case is filled with a mixture that contains a magnetic powder and resin that form the magnetic core so as to cover an outer periphery of the coil after the disposing step has been performed.

Leaving-to-stand step: The mixture is left to stand so that, after the filling step has been performed, the magnetic powder is caused to settle on the bottom surface side of the case by a difference in specific gravity between the magnetic powder and the resin, thereby forming a surface layer, which contains a smaller amount of the magnetic powder than a portion further to the inside of the mixture, on a surface portion of the mixture.

Curing step: The resin is cured after the leaving-to-stand step has been performed.

According to the above-described method, the leaving-to-stand step causes the magnetic powder to settle on the bottom surface side of the case due to the difference in specific gravity between the magnetic powder and the resin. Thus, the resin to be contained in the magnetic core tends to gather on the opening portion side of the case, and accordingly, the surface layer containing a smaller amount of the magnetic powder than the portion further to the inside of the mixture can be formed on the surface portion of the mixture. In the next curing step, the magnetic core and the surface layer can be simultaneously formed. Thus, the magnetic core and the surface layer can be formed so as to be continuous with each other without the interface formed therebetween. Accordingly, the reactor, the magnetic core of which contains the magnetic powder that does not easily corrode and which is not easily degraded due to corrosion of the magnetic powder, can be manufactured.

Also according to this method, in order to form the magnetic core and the surface layer, a step of filling an additional member to form the surface layer is not needed after the case has been filled with the mixture once. Furthermore, since there is no need of preparing or providing a separate covering member, the reactor can be manufactured with good productivity.

In a second manufacturing method for a reactor according to the present invention, the reactor is manufactured by disposing in a case, which has an opening portion and a bottom surface that opposes the opening portion, an assembly of a coil, which is formed by winding a wire, and a magnetic core, in which the coil is disposed. The method includes the following steps.

Disposing step: The coil is disposed in the case.

Filling step: The case is filled with a mixture that contains a magnetic powder and resin that form the magnetic core so as to cover an outer periphery of the coil after the disposing step has been performed.

Refilling step: The case is refilled with resin containing no magnetic powder, the resin being resin the composition of which is similar to the resin contained in the mixture, after the filling step has been performed and before the resin contained in the mixture is cured.

Curing step: The resin in the case is cured after the refilling step has been performed.

According to the above-described method, after the filling step has been performed, the case is refilled in the refilling step with the resin containing no magnetic powder, the resin being resin the composition of which is similar to the resin contained in the mixture, before the above-described mixture is cured. Thus, the surface layer that is free of the magnetic powder can be more reliably formed in a shorter time. Since the resin with which the case is filled in the filling step and the resin with which the case is filled in the refilling step are simultaneously cured, the magnetic core and the surface layer are simultaneously formed. Thus, the magnetic core and the surface layer can be formed so as to be continuous with each other without the interface formed therebetween and air does not remain between the magnetic core and the surface layer. Accordingly, the reactor, the magnetic core of which contains the magnetic powder that does not easily corrode and which is not easily degraded due to corrosion of the magnetic powder, can be manufactured.

Furthermore, according to this method, since there is no need of preparing or providing a separate covering member, the reactor can be manufactured with good productivity.

As a form of the present invention, the magnetic core has an internal core portion formed of a compact and a core coupling portion formed of the mixture. The internal core portion is disposed in the coil before the filling step is performed, and after that, in the filling step, the case is filled with the mixture so as to cover an outer periphery of a combination of the coil and the internal core portion.

According to the above-described structure, in order to join the internal core portion and the core coupling portion to each other, both the portions can be integrated with each other by the resin contained in the mixture. Thus, there is no need of adhesive, and bonding step is not performed. Furthermore, the surface layer can be formed at the same time as the formation of the core coupling portion. When the internal core portion is formed of a compact, eddy current losses occurring in the reactor can be reduced. The reason of this is as follows: since a compact is typically formed by compressing and molding a coated magnetic powder, which is a magnetic powder coated with an insulating film, particles of the magnetic powder are insulated from one another. Reduction in these losses is particularly advantageous in the case where the coil is supplied with high-frequency power.

Advantageous Effects of Invention

The reactor according to the present invention includes the surface layer on the surface of the magnetic core on the opening portion of the case side. This can prevents the magnetic powder from rusting. Furthermore, since the surface layer is formed so as to be continuous with the magnetic core without the interface formed therebetween, the surface layer is not separated when the surface layer is exposed to a heat cycle that occurs due to operation of the reactor. In addition, unlike the case where the separate covering member or the like corresponding to the lid is provided, air does not remain between the covering member and the magnetic core. Thus, the magnetic core is not easily degraded, and accordingly, magnetic characteristics are not easily degraded.

In the manufacturing method for the reactor according to the present invention, the surface layer can be formed on the opening portion of the case side of the magnetic core at the same time as the formation of the magnetic core. The surface layer has the resin portion similar to the resin of the magnetic core and contains a smaller amount of the magnetic powder than a portion further inside than the surface layer. Accordingly, there is no need of preparing or providing the separate covering member. As a result, the reactor can be manufactured with a simple structure using fewer components and magnetic characteristics of the magnetic core of the reactor are not degraded. Since the manufacturing process of the reactor can also be simplified, the reactor can be manufactured with good productivity.

Reference Signs List

Figure 1A:
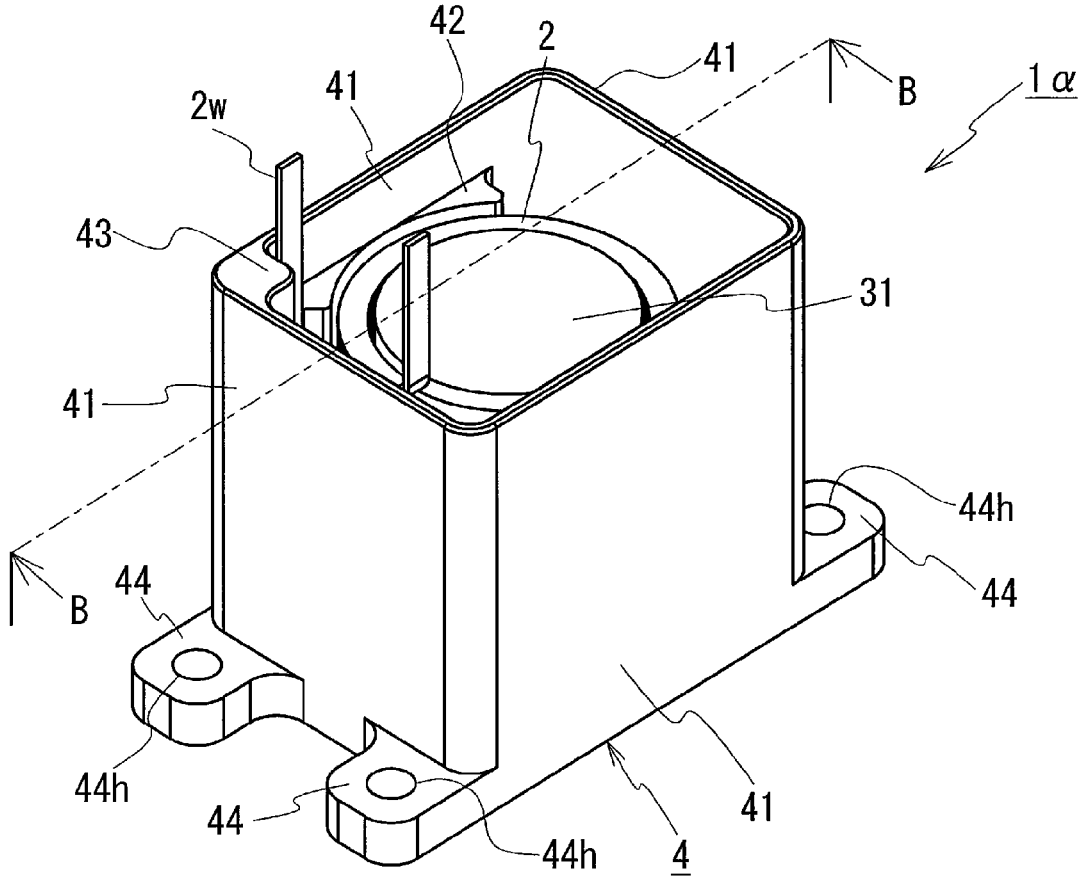
FIG. 1A is a perspective view illustrating an outline of a reactor according to a first embodiment.

| | | | |
|---|---|---|---|
| 1α, 1β, 1γ | reactor | | |
| 10 | assembly | | |
| 2 | coil | 2w | wire |
| 3 | magnetic core | | |
| 31 | internal core portion | 32 | core coupling portion |
| 4 | case | | |
| 40 | bottom surface | 41 | sidewall |
| 42 | guide protrusion portion | 43 | positioning portion |
| 44 | mounting portion | 44h | bolt hole |
| 5 | surface layer | | |
| 6 | coil molded product | | |
| 60 | internal resin portion | | |

DESCRIPTION OF EMBODIMENTS

Embodiments according to the present invention will be described below. Here, a reactor will be described with reference to FIGS. 1A, 1B, and 2, and then a manufacturing method for a reactor will be described. In the drawings, the same reference numerals denote components of the identical names.

<<First Embodiment>>

<Reactor>

Figure 1B:
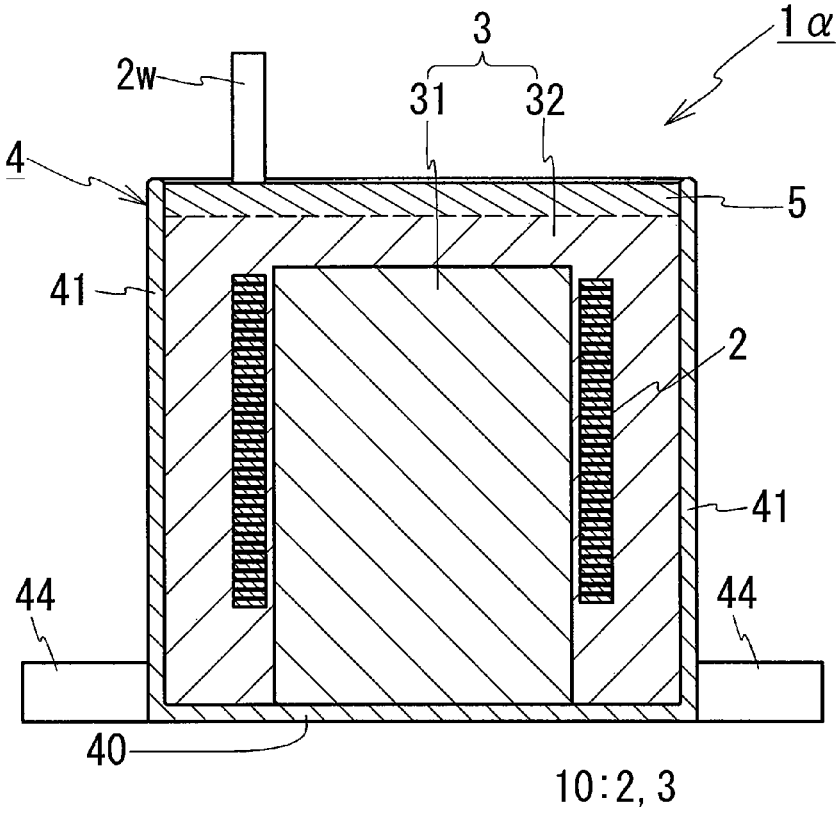
FIG. 1B is a sectional view of the reactor taken along line B-B in FIG. 1A.

As illustrated in FIGS. 1A and 1B, a reactor 1α is a so-called pot-type reactor and includes a coil 2 and a magnetic core 3. The coil 2 is formed by winding a wire 2*w*. The coil 2 is disposed in the magnetic core 3. The reactor 1α also includes a case 4 that houses an assembly 10 formed of the coil 2 and the magnetic core 3. The magnetic core 3 includes an internal core portion 31 and a core coupling portion 32. The internal core portion 31 is inserted through the coil 2. The core coupling portion 32 is disposed on an outer periphery of the coil 2 and connected to the internal core portion 31. Both the core portions 31 and 32 form a closed magnetic circuit. The core coupling portion 32 is formed of a molded solid body containing magnetic powder and resin. The coil 2 is sealed in the case 4 with the outer periphery thereof substantially covered by the core coupling portion 32. A surface layer 5 is provided on a surface of the magnetic core 3 on the opening portion of the case 4 side. These components are described in detail below.

[Coil]

The coil 2 is a cylindrical body formed by winding a single continuous wire in a spiral shape. The wire 2*w* is preferably a covered wire that includes a conductor formed of an electrically conducting material such as copper or aluminum covered by an insulating cover formed of an electrically insulating material at the outer periphery thereof. Here, a covered rectangular wire is used, the conductor of which is a copper rectangular wire and the insulating cover of which is formed of enamel (typically polyamide-imide). The thickness of the insulating cover is preferably from 20 to 100 μm. As the thickness of the insulating cover is increased, the formation of pin holes can be reduced and insulating properties can be increased. The coil 2 is formed by winding the covered rectangular wire edgewise. By forming the coil into a cylindrical shape, the coil is comparatively easily formed even when the wire 2*w* is wound edgewise. Other than a rectangular shape, the wire 2*w* may use a conductor having any of a variety of sectional shapes such as circular shape and polygonal shape. Although a single coil 2 is formed by a single wire in the present example, the coil may be formed as follows: a pair of spiral bodies are arranged parallel to each other, and part of a single wire is bent to form a couple portion.

Both end portions of the wire 2*w* that forms the coil 2 appropriately extend from turns to the outside of the surface layer 5 through the core coupling portion 32, and the conducting portions of the wire 2*w*, the conducting portions being exposed with portions of the insulating cover stripped off, are connected to terminal members (not shown) formed of a conducting material such as copper or aluminum. Through these terminal members, an external device (not shown) such as a power unit that supplies power to the coil 2 is connected. The conducting portions of the wire 2*w* may be connected to the terminal members by welding such as tungsten-inert-gas (TIG) welding, crimping, or another technique. Here, although both the end portions of the wire 2*w* extend so as to be parallel to the axial direction of the coil 2, the direction in which the end portions of the wire 2*w* extend may be appropriately selected.

In the present example, when the reactor 1α is disposed in a target object, the coil 2 is housed in the case 4 such that the axial direction of the coil 2 perpendicularly intersects a bottom surface 40 of the case 4 (this form of arrangement is referred to as a vertical arrangement hereafter).

[Magnetic Core]

The magnetic core 3 includes the internal core portion 31 and the core coupling portion 32. The cylindrical internal core portion 31 is inserted through the coil 2. The core coupling portion 32 is formed so as to cover the outer periphery of a combination of the coil 2 and the internal core portion 31. The magnetic core 3 is a so-called pot-type core, which has an E-E shape formed by combining two Es in the section taken along the axial direction of the coil 2. In the reactor 1α, the internal core portion 31 and the core coupling portion 32 may be formed of the same material or different materials. In particular, the internal core portion 31 and the core coupling portion 32 are preferably formed of different materials so that the core portions 31 and 32 have different magnetic characteristics. Specifically, the saturation flux density of the internal core portion 31 is preferably higher than that of the core coupling portion 32, and the magnetic permeability of the core coupling portion 32 is preferably lower than that of the internal core portion 31.

{Internal Core Portion}

The internal core portion 31 has a cylindrical outer shape that conforms to the shape of an inner peripheral surface of the coil 2. The length of the internal core portion 31 in the axial direction of the coil 2 (simply referred to as "length" hereafter) may be appropriately selectable. In the present example, the length of the internal core portion 31 is slightly longer than that of the coil 2, and end surfaces and regions near the end surfaces of the internal core portion 31 protrude from end surfaces of the coil 2. Alternatively, the length of the internal core portion 31 may be equal to or slightly shorter than that of the coil 2. When the length of the internal core portion 31 is equal to or longer than that of the coil 2, the magnetic flux generated by the coil 2 is allowed to sufficiently pass to the internal core portion 31. The lengths by which the internal core portion 31 protrudes from the coil 2 may also be appropriately selectable. The length by which the internal core portion 31 protrudes from one end surface of the coil 2 may be larger than the length by which the internal core portion 31 protrudes from the other end surface of the coil 2 as is the case with the present example. Alternatively, the internal core portion 31 may protrude from both the end surfaces of the coil 2 by the same length. In particular, in the above-described vertical arrangement, when the internal core portion 31 is disposed in the case 4 such that the one end surface of the internal core portion 31 that protrudes from the one end surface of the coil 2 is in contact with the bottom surface 40 of the case 4 as is the case with the present example, the internal core portion 31 can be stably disposed in the case 4, thereby facilitating formation of the core coupling portion 32.

Such an internal core portion 31 may be made of a compact formed of a soft magnetic powder, the particles of which have insulating films, a layered steel sheet formed by stacking a plurality of magnetic steel sheets having insulating films, or a molded solid body formed of a mixture that contains a magnetic powder and resin.

(Compact)

A compact can be typically obtained by molding a soft magnetic powder, the particles of which have insulating films on their surfaces, or a mixed powder including a binder appropriately mixed into the soft magnetic powder, and then firing the molded structure at a temperature equal to or below a heatproof temperature of the insulating film. The compact can be easily molded into a three-dimensional body. For example, an internal core portion having an outer shape that conforms to the shape of an inner peripheral surface of a coil can be easily formed. Furthermore, since the compact has an insulating material between the particles of the magnetic powder, the particles of the magnetic powder are insulated from one another. This allows eddy current losses to be reduced, and even in the case where the coil is energized by high-frequency power, the eddy current losses can still be reduced.

The above-described soft magnetic powder may use a powder of an Fe-based alloy such as an Fe—Si, Fe—Ni, Fe—Al, Fe—Co, Fe—Cr, or Fe—Si—Al alloy, a rare earth metal powder, a ferrite powder, or the like in addition to a powder of an iron group metal such as Fe, Co, or Ni. In particular, use of a Fe-based alloy powder allows a compact having a high saturation flux density to be easily obtained compared to a case in which a magnetic material such as ferrite is used. Examples of the material of the insulating film formed on the particles of the soft magnetic powder include a phosphate compound, a silicon compound, a zirconium compound, an aluminum compound, and a boron compound. Examples of the binder include thermoplastic resin, non-thermoplastic resin, and higher fatty acid. The binder may be lost by the above-described firing or may be changed into an insulating material such as silica. A known compact may be used.

The saturation flux density of the compact can be changed by adjusting the material of the soft magnetic powder, a mixing ratio at which the soft magnetic powder and the binder are mixed, the amounts of various films, and the like. For example, a compact having a high saturation flux density can be obtained by using a soft magnetic powder having a high saturation flux density or by decreasing the amount of the combined binder so as to increase the mixing ratio of the soft magnetic powder. In addition, the saturation flux density also tends to increase by changing molding pressure, more specifically, by increasing the molding pressure. Selection of the material of the soft magnetic powder, adjustment of the molding pressure, or the like may be performed so that a desired saturation flux density is obtained.

(Layered Steel Sheet)

The layered steel sheet is formed of a layered structure, in which a plurality of magnetic steel sheets having insulating films are stacked one on top of another. Use of the magnetic steel sheets for the internal core portion facilitates, for example, obtaining of the magnetic core, the saturation flux density of which is higher compared to a case in which a compact is used.

(Molded Solid Body)

The molded solid body is formed of a mixture including a magnetic powder and resin. Typically, such a molded solid body can be formed by injection molding or cast molding. In injection molding, the magnetic powder formed of a magnetic material and resin having fluidity are mixed with each other. The mixture is poured into a mold with a specified pressure applied to be molded, and then the resin is cured. In cast molding, the mixture similar to that used in injection molding is obtained. Then, the mixture is poured into a mold without pressure being applied thereto so as be molded and cured.

In either of the above-described molding techniques, any of the magnetic powders similar to the above-described soft magnetic powders may be used. In particular, powders of iron-based materials such as a pure iron powder or a Fe-based alloy powder are preferably used as the soft magnetic powder. Since the iron-based materials have saturation flux densities and magnetic permeabilities higher than those of other materials such as ferrite, even when the ratio of the resin content is high, a core having a certain degree of the saturation flux density and the magnetic permeability can be obtained. Alternatively, coated powders having films formed of iron phosphate or the like on the surfaces of particles made of a soft magnetic material may be used. These magnetic powders are easily used when the average particle size is from 1 to 1000 μm, particularly from 10 to 500 μm, more particularly from 30 to 150 μm.

In either of the above-described molding techniques, resin used as the binder is preferably thermosetting resin such as epoxy resin, phenolic resin, or silicone resin. In the case where thermosetting resin is used, the molded body is heated so that the resin is heat cured. The binder may be formed of room-temperature setting resin or cold setting resin. In this case, the molded body is left in a room temperature to comparatively low temperature environment so that the resin is cured. The molded solid body contains a comparatively large amount of non-magnetic resin compared to the compact or a magnetic steel sheet.

A filler formed of ceramic such as alumina or silica may be mixed into the material of the molded solid body in addition to the magnetic powder and resin used as the binder. By adding the above-described filler, the specific gravity of which is comparatively smaller than the magnetic powder, non-uniform gathering of the magnetic powder can be suppressed, and accordingly, the core coupling portion in which the magnetic powder is uniformly distributed over the entirety of the core coupling portion can be easily obtained. Furthermore, when the above-described filler is formed of a material having a good thermal conductivity, the filler can contribute to improvement of heat dissipation properties. When the above-described filler is mixed into the material, the ratio of the total content of the magnetic powder and the filler is 20 to 70% by volume when ratio of the core coupling portion is assumed to be 100% by volume.

The magnetic permeability and the saturation flux density of the molded solid body can be adjusted by changing the combination ratio of the magnetic powder and the resin used as the binder. For example, by reducing the magnetic powder content, the molded solid body having a low magnetic permeability is obtained.

For example, when the internal core portion is formed of the molded solid body, the internal core portion is formed of the material of the same type as that of the core coupling portion. In this case, the entirety of the magnetic core may be formed of the same material, and accordingly, the internal core portion and the core coupling portion may be simultaneously formed. That is, both the core portions may be integrated with each other. The internal core portion may be initially formed instead of simultaneously forming both the core portions. In this case, the magnetic permeability and the saturation flux density can be appropriately selected, and accordingly, the magnetic properties of both the materials can be different from each other. Thus, for example, the saturation flux density of the internal core portion can be set to be higher than that of the core coupling portion, and the magnetic permeability of the core coupling portion can be set to be lower than that of the internal core portion.

Here, the internal core portion 31 used is formed of the above-described compact. Although the internal core portion 31 is formed as a solid body without a gap member or an air gap, a gap member or an air gap may be appropriately provided or formed in the internal core portion 31. For example, the internal core portion 31 may include a plurality of separate pieces, which are integrated with one another by bonding using an adhesive.

{Core Coupling Portion}

The core coupling portion 32 together with the internal core portion 31 forms a closed magnetic circuit. In addition, the core coupling portion 32 covers the outer periphery of the combination of the coil 2 and the internal core portion 31 and also serves as a sealing member that seals the coil 2 and the internal core portion 31 in the case 4.

The material of the core coupling portion 32 is made of the molded solid body containing the magnetic powder and the resin as described above. That is, the molded solid body here may be formed of the same magnetic powder and the resin as the material of the molded solid body mentioned above in the description of the internal core portion 31. In the reactor 1 α, the molded solid body, which contains the magnetic powder and the resin, extends from the bottom surface 40 to the opening side of the case. The core coupling portion 32 is formed of this molded solid body. The magnetic powder contained in the core coupling portion 32 may be uniformly distributed over a region in the case 4 from the opening side to the bottom surface 40. Alternatively, the magnetic powder may be sparsely distributed on the opening side of the case 4 and densely distributed on the bottom surface 40 side of the case 4. In this case, the magnetic powder, which has a high thermal conduction rate, tends to gather on the bottom surface side of the case 4. Thus, when the bottom surface 40 of the case 4 is on a mounting surface side of the reactor 1 α, heat generated by the coil 2 is easily dissipated when a cooling means such as a cooling base is provided on the bottom surface side of the case 4. Furthermore, this core coupling portion 32 and the above-described internal core portion 31 are joined to each other by resin contained in the core coupling portion 32 without an adhesive applied therebetween. Accordingly, the magnetic core 3 is an integrated member without using an adhesive or a gap member through the entirety of the magnetic core 3.

In the present example, the core coupling portion 32 is made of a molded solid body formed of a mixture of epoxy resin and a coated powder of an iron-based material, which has an average particle size of 75 μm or smaller and is provided with an insulating film.

In the structure described here, the core coupling portion 32 covers the substantially whole periphery of the combination of the coil 2 and the internal core portion 31. However, part of the coil 2 is not necessarily covered by the magnetic core 3 (however, covered by the case 4) as long as at least an upper portion of a region of the coil 2 disposed on the opening portion of the case 4 side is covered by the magnetic core 3.

As is the case with the present example, by forming both the core portions 31 and 32 using different materials, for example, using the compact for the internal core portion 31 and using the molded solid body for the core coupling portion 32, the saturation flux density of the internal core portion 31 can be higher than that of the core coupling portion 32, and the magnetic permeability of the core coupling portion 32 can be lower than that of the internal core portion 31. That is, with the internal core portion 31 having a higher saturation flux density, in order to obtain a certain magnetic flux, the sectional area of the internal core portion can be reduced compared to a reactor, for example, structured as follows: the entire magnetic core is formed of a single material, and accordingly, the internal core portion and the core coupling portion have the same saturation flux density. Thus, an outer diameter of the coil provided at the outer periphery of the internal core portion can be reduced, and the size of the reactor can be further reduced. Furthermore, since the outer diameter of the coil can be reduced, the length of the wire, by which the coil is formed, can be reduced, and accordingly, the resistance of the coil can be reduced. Thus, losses can be reduced. In consideration of reduction in size and losses of the coil, the saturation flux density of the internal core portion becomes more preferable as the saturation flux density of the internal core portion 31 becomes greater than that of the core coupling portion. There is no upper limit of the saturation flux density of the internal core portion. By making the magnetic permeability of the core coupling portion be lower than that of the internal core portion, a specified inductance can be sufficiently satisfied.

<<Magnetic Characteristics>>

The saturation flux density of the internal core portion 31 is preferably equal to or greater than 1.6 T, more preferably, equal to or greater than 1.8 T, and yet more preferably, equal to or greater than 2 T. Furthermore, the saturation flux density of the internal core portion 31 is preferably equal to or greater than 1.2 times that of the core coupling portion 32, more preferably, equal to or greater than 1.5 times that of the core coupling portion, and yet more preferably, 1.8 times that of the core coupling portion 32. The sectional area of the internal core portion 31 can be reduced when the internal core portion 31 has a saturation flux density sufficiently high relative to that of the core coupling portion 32. The relative magnetic permeability of the internal core portion 31 is preferably from 50 to 1000, more preferably, from about 100 to 500.

The saturation flux density of the core coupling portion 32 is preferably equal to or greater than 0.5 T and less than that of the internal core portion 31. The relative magnetic permeability of the core coupling portion 32 is preferably from 5 to 50, more preferably, from 5 to 30. When the relative magnetic permeability of the core coupling portion 32 satisfies the above-described range, an excessive increase in average magnetic permeability of the entirety of the magnetic core 3 can be prevented, and accordingly, for example, a gapless structure can be realized.

Here, the saturation flux density of the internal core portion 31 is 1.8 T and the relative magnetic permeability of the internal core portion 31 is 250; and the saturation flux density of the core coupling portion 32 is 1 T and the relative magnetic permeability of the core coupling portion 32 is 10. The materials of the internal core portion 31 and the core coupling portion 32 may be adjusted so that desired saturation flux density and relative magnetic permeability are obtained.

[Case]

The case 4 that houses the assembly 10 of the coil 2 and the magnetic core 3 is a rectangular box body and includes the bottom surface 40 and sidewalls 41. The bottom surface 40 comes to the mounting side of the reactor 1α when the reactor 1α is disposed in the target object (not shown). The sidewalls 41 stand erect on the bottom surface 40. The case 4 opens on a side opposite the bottom surface 40.

The shape and size of the case 4 may be appropriately selected. For example, the case 4 may have a cylindrical shape that conforms to the shape of the above-described assembly 10. The case 4 is preferably formed of an electrically conducting and non-magnetic material such as aluminum, an aluminum alloy, magnesium, or a magnesium alloy. A case formed of an electrically conducting non-magnetic material can effectively prevent a magnetic flux from leaking to the outside of the case. Furthermore, the case formed of light-weight metal such as aluminum, magnesium, or an alloy of aluminum or magnesium, which has strength greater than resin and is light in weight, is preferably used for an automotive part, the weight of which is desired to be reduced. Here, the case 4 is formed of aluminum.

Other than the above description, the case 4 used in the present example has guide protrusion portions 42, a positioning portion 43, and a coil support portion (not shown). The guide protrusion portions 42 provided on inner peripheral surfaces of the sidewalls 41 suppress rotation of the coil 2 and function as guides when the coil 2 is inserted. The positioning portion 43 protrudes at a corner of inner peripheral surfaces of the case 4 and used to position the end portion of the wire 2*w*. The coil support portion protrudes from the bottom surface 40 for the inner peripheral surfaces of the case 4, supports the coil 2, and positions the height of the coil 2 with respect to the case 4. By using the case 4 that has the guide protrusion portions 42, the positioning portion 43, and the coil support portion, the coil 2 can be precisely disposed at a desired position in the case 4, and accordingly, the internal core portion 31 can be precisely positioned with respect to the coil 2. The guide protrusion portions 42 and the like may be omitted. Alternatively, separate members are prepared and disposed in the case so as to be used to, for example, position the coil 2. In particular, when these separate members are formed of molded solid bodies made of a material similar to that of the core coupling portion 32, the separate members can be easily integrated while the core coupling portion 32 is formed, and the separate members can be used as magnetic paths. Furthermore, the case 4 has mounting portions 44 having bolt holes 44*h*. The mounting portions 44 are used to secure the reactor la to the target object (not shown) with bolts. With the mounting portions 44, the reactor 1α can be easily secured to the target object with bolts.

[Surface Layer]

The surface layer 5 prevents the magnetic powder contained in the magnetic core 3 from rusting and is provided on the surface of the magnetic core 3 on the opening portion of the case 4 side. As will be described later, the surface layer 5 has a thickness equal to or larger than the average particle size of the magnetic powder and contains no or a small amount of the magnetic powder. The surface layer 5 has a resin portion formed of resin similar to that contained in the magnetic core 3 and is formed so as to be continuous with the magnetic core 3 without an interface formed therebetween. Here, rust prevention refers to covering of the magnetic powder with the resin portion to the degree that the magnetic characteristics of the magnetic core are not substantially degraded. That is, although all the particles of the magnetic powder are most preferably covered by the resin portion and not exposed to outside air, exposure or the like of slight amount (about several particles) of the magnetic powder to outside air is allowable. Formation of the surface layer 5 continuous with the magnetic core 3 without the interface formed therebetween refers to a structure, in which at least part of the resin portion of the surface layer, the part being a part where curing reaction occurs, and at least part of the resin contained in the magnetic core, part being a part where curing reaction occurs, are superposed each other, thereby both the resins are combined to each other. That is, both the components are integrated with each other in tight contact with each other. It is particularly preferable that a boundary between both the components be not formed.

As described above, it is sufficient that the material of the surface layer 5 have the resin portion made of resin similar to the resin that is contained in the magnetic core 3. In particular, as is the case with the present example, the surface layer 5 is more preferably formed of part of the resin of the magnetic core 3, that is, the resin of the magnetic core 3 is shared between the surface layer 5 and the magnetic core 3, because, as described above, the surface layer 5 is easily formed so as to be continuous with the magnetic core 3 without the interface formed therebetween. It is still more preferable that the surface layer 5 do not contain the above-described magnetic powder. Here, the similar resin may refer to, for example, a resin, the base resin of which is the same as that of the resin contained in the magnetic core 3, and having a composition different from the resin contained in the magnetic core 3, in addition to resin having completely the same composition as the resin of the magnetic core 3. The specific examples of such a resin include epoxy resin.

As described above, the thickness of the surface layer 5 is sufficient if the magnetic powder can be prevented from rusting. Specifically, the thickness of the surface layer 5 is assumed to be a depth equal to or larger than the average particle size of the magnetic powder from the surface of the magnetic core on the opening portion side, and a depth of a region that includes ten or fewer (including zero) particles of the magnetic powder per specified area of a field of view. The number of particles of the magnetic powder is obtained by observing the longitudinal section of the surface layer 5 using a microscope and by counting the number of particles of the magnetic powder exposed on the section in a region from the surface of the magnetic core on the opening portion side to a specified depth equal to or larger than the average particle size of the magnetic powder using the following method. More specifically, one inspection field of view is defined as follows: "10 times the average particle size of the magnetic powder"× "10 times the average particle size of the magnetic powder". Three or more fields of view, which are spaced apart from one another in the width direction (direction perpendicular to the depth direction) of the section, are defined. The number of particles of the magnetic powder is counted in each field of view and the average of the numbers is calculated. The average number is assumed to be the number of the particles of the magnetic powder in the depth region defined by the fields of view. In the above-described inspection, as the number of fields of view increases, the average can theoretically tend to converge toward a specified value. Thus, it is preferable that the number, toward which the calculated average converges, be the number of particles of the magnetic powder in the depth region defined by the inspection fields of view. Next, the above-described inspection fields of view are shifted in the depth direction of the section at an appropriate interval, the similar inspection is repeatedly performed, and the number of particles of the magnetic powder in the depth region similarly defined by the inspection fields of view is obtained. The inspection fields of view of a particular depth region and those of the next depth region may be adjacent to one another or partly superposed on one another. This inspection is repeatedly performed until the above-described average value exceeds ten. The depth of the inspection fields of view, in which the average value is equal to or less than ten, is determined to be the thickness of the surface layer 5. In order to perform the above-described inspection, a region of the magnetic powder and the resin portion may be recognized by a computer from an image of the longitudinal section and subjected to automatic measurement, or, according to need, an original image of the longitudinal section may be subjected to image processing such as binarization. Since the magnetic powder used in the present example has an average particle size of 75 μm, the number of the particles of the magnetic powder is obtained in the depth direction from the surface of the magnetic core using inspection fields of view of 750-μm square. When the above-described inspection is performed with the number of fields of view in the width direction in the section of the magnetic core set to three, the thickness of the surface layer 5 obtained is about 2 mm. A typical thickness of this surface layer 5 is from about 0.1 to 5.0 mm. By setting the thickness of the surface layer 5 to such a value, degradation of the magnetic core can be easily prevented from occurring while the surface layer 5 does not have an excessive thickness.

The surface layer 5 as described above can be formed by a manufacturing method described later.

(Other Components)

In order to further improve insulation between the coil 2 and the magnetic core 3 and insulation between the coil 2 (end portion sides of the wire 2*w* in particular) and the surface layer 5, insulating materials are preferably provided in portions of the coil 2, the portions being in contact with the magnetic core 3 or the surface layer 5. Providing insulating materials includes, for example, attaching insulating tape or providing insulating paper or sheets on the inner and outer peripheral surfaces of the coil 2 and providing insulating tubes at part of the wire 2*w* that forms the coil 2. A bobbin (not shown) formed of an insulating material may be disposed at the outer periphery of the internal core portion 31. The bobbin may have a cylindrical body that covers the outer periphery of the internal core portion 31. Use of a bobbin having annular flange portions that extends outward from both end edges of the cylindrical body allows insulation between the end surfaces of the coil 2 and the core coupling portion 32 to be improved. The bobbin is preferably formed of insulating resin such as polyphenylene sulfide (PPS) resin, liquid crystal polymer (LCP), or polytetrafluoroethylene (PTFE) resin.

[Size of Reactor]

When the volume of the reactor 1α including the case 4 is set to about 0.2 (200 $cm^3$) to 0.8 liters (800 $cm^3$), the reactor 1α can be preferably utilized for an on-vehicle component (here, 280 $cm^3$).

[Application]

The reactor 1α can be preferably utilized for applications that are energized under, for example, the following conditions: the maximum current (direct current) is about 100 to 1000 A, the average voltage is about 100 to 1000 V, and the operating frequency is about 5 to 100 kHz. Typical examples of such applications include a component used in an on-vehicle power conversion device installed in an electric vehicle, a hybrid vehicle, or the like.

<Manufacturing Method for Reactor (I)>

The above-described reactor 1α can be manufactured by performing, for example, a disposing step, a filling step, a leaving-to-stand step, and a curing step in this order as follows. The steps are described below.

[Disposing Step]

Figure 2:
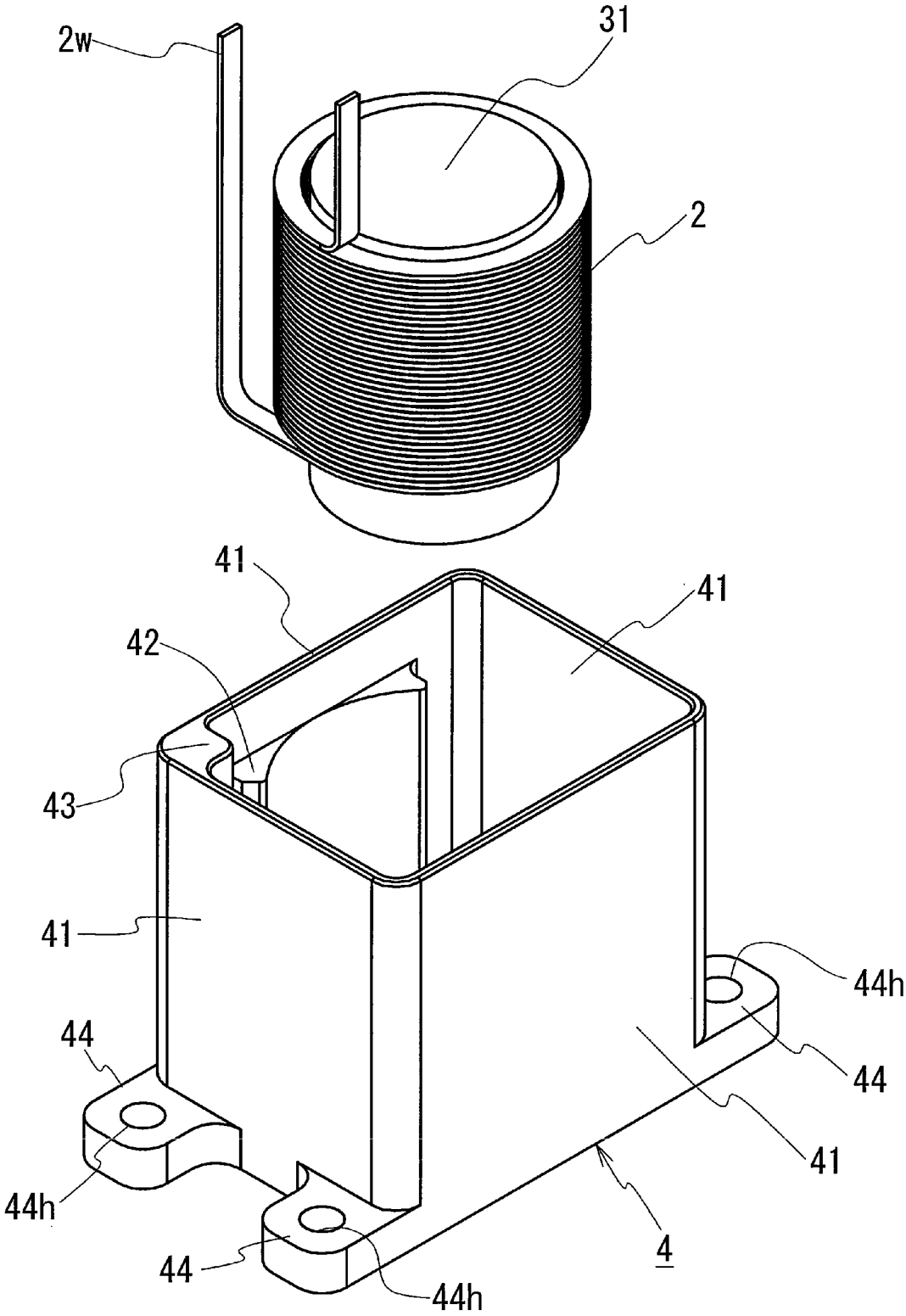
FIG. 2 is a general exploded view for explaining components of the reactor according to the first embodiment.

In the disposing step, the coil 2 is disposed in the case 4. As is the case with the present example, when the internal core portion 31 is formed of a compact or the magnetic steel sheet, the combination of the coil 2 and the internal core portion 31 is produced before the next step, that is, the filling step, is performed, for example, in this disposing step. The combination is produced by preparing the coil 2 and the internal core portion 31 and inserting the internal core portion 31 through the coil 2 as illustrated in FIG. 2. This combination may be produced in any step as long as the combination is produced before the next filling step is performed. Furthermore, as described above, the insulating material may be appropriately provided between the coil 2 and the internal core portion 31. The above-described combination is disposed in the case 4. When the combination is disposed in the case 4, use of the guide protrusion portions 42 or the like provided in the case 4 as described above allows the combination to be precisely disposed at a specified position in the case 4. In contrast, when the internal core portion 31 is formed of a molded solid body similar to the core coupling portion 32, the coil 2 is disposed in the case 4 in this disposing step.

[Filling Step]

In the filling step, after the above-described combination is disposed in the case 4, the case 4 is filled with the mixture containing the magnetic powder and resin to be contained in the magnetic core 3. In the present example, the case 4 is filled with the mixture of the magnetic powder to be contained in the core coupling portion 32 out of the magnetic core 3, and resin to be contained in both the core coupling portion 32 and the surface layer 5. By performing this step, the outside of the combination is covered by the mixture.

The core coupling portion 32, the relative magnetic permeability of which is 5 to 50 as described above, and the surface layer 5 can be formed by setting the contents of the magnetic powder and the resin in the mixture of the magnetic powder and the resin (before being cured) respectively to about 20 to 60% by volume and 40 to 80% by volume. The resin used here preferably has such a viscosity that the magnetic powder tends to gather on the bottom surface side of the case and the resin tends to gather on the opening side of the case because, when such a resin is used, the surface layer 5 is easily formed in a shorter time and the surface layer 5 substantially free of the magnetic powder is easily formed. In the present example, 40% by volume phosphate-coated pure iron powder as the magnetic powder, 60% by volume bisphenol A-type epoxy resin as the resin, and an acid anhydride as a curing agent for this resin are prepared and mixed to form the mixture, and the case 4 is filled with the mixture. As is the case with the present example, when the resin contained in the core coupling portion 32 and the resin contained in the surface layer 5 are homogeneous, the core coupling portion 32 and the surface layer 5 are easily brought into tight contact with each other. Here, although acid anhydride is used as the curing agent for bisphenol A-type epoxy resin, the curing agent may be appropriately selected in accordance with the type of resin to be used.

[Leaving-to-Stand Step]

A leaving-to-stand step is performed after the case 4 is filled with the mixture of the magnetic powder and the resin instead of immediately curing the resin. In the leaving-to-stand step, the mixture is left to stand with the temperature maintained at which the resin is not cured in a constant temperature bath until the magnetic powder settles on the bottom surface side of the case 4 and a surface layer, which contains a smaller amount of the magnetic powder than a portion further inside than the surface layer, is formed in a surface portion of the mixture due to the difference in specific gravity between the magnetic powder and the resin. More preferably, the mixture is left to stand until the surface layer 5, which is substantially free of the magnetic powder, is formed. In the present example, the surface layer 5 that is about 2 mm in thickness is formed by leaving the mixture to stand for about 20 to 30 minutes.

The time for the mixture to be left to stand may be appropriately selected in accordance with resin to be used and a desired thickness of the surface layer to be formed. It is particularly preferable that the mixture be left to stand until the surface layer becomes substantially free of the magnetic powder. However, when the vertical arrangement is adopted as in the present example, the magnetic powder needs to be distributed so as to cover both the end surfaces and the outer periphery of the coil 2, so that sufficient magnetic paths are formed.

The state in which the magnetic powder and the resin are separated can be grasped by, for example, when the resin is transparent, visually checking the color of the powder through the opening portion of the case 4. The time to leave the mixture to stand may be adjusted while performing the visual check. The time taken to separate the magnetic powder and the resin may change depending on the magnetic powder and the resin to be used. Accordingly, by creating test pieces formed of a variety of materials and obtaining time to leave the mixture to stand for each of the materials in advance so as to allow the time to leave the mixture to stand to be appropriately selected later in accordance with the materials, the reactor can be manufactured with good productivity. When the test pieces are created using transparent cases, the surface of the mixture can be visually checked through the opening portion of the case as described above, and furthermore, the mixture can be easily visually checked from the outside of the case 4.

[Curing Step]

The curing step is performed after the above-described leaving-to-stand step. In the curing step, the resin is cured with the surface layer 5 as described above has been formed. In this curing step, the temperature and time may be appropriately selected in accordance with the type of resin to be cured. In the present example, the mixture is left to stand with the temperature maintained at about 80° C. for about two hours, at about 120° C. for about two hours, and then at about 150° C. for about four hours so as to cure the resin and obtain the reactor 1α.

[Other Step]

As the other step, after the case 4 is filled with the mixture of the magnetic powder and the resin in the filling step and before performing the leaving-to-stand step, air purging may be performed as a deaeration process in order to eliminate voids in the mixture. Performing air purging is preferred because voids in the mixture can be eliminated, and accordingly, desired magnetic characteristics of the core coupling portion 32 are easily obtained. <Manufacturing Method for Reactor (II)>

Alternatively, the reactor 1α may be manufactured, for example, as follows. The difference between the present method and the above-described manufacturing method (I) is that, in the present method, the leaving-to-stand step performed in the above-described manufacturing method (I) is not performed and refilling step is included. In the refilling step, which is performed after the filling step, the case 4 is refilled with the resin containing no magnetic powder, the resin being resin the composition of which is similar to that of the resin to be contained in the magnetic core, before the mixture with which the case 4 has been filled in the filling step is cured. That is, in the present example, the reactor is manufactured by performing the disposing step, the filling step, the refilling step, and the curing step in this order. Here, the refilling step, which is the difference between the manufacturing method (I) and the manufacturing method (II), is described.

[Refilling Step]

In the refilling step, in order to form the surface layer 5, before the mixture of the magnetic powder and the resin, the mixture being a mixture with which the case 4 has been filled in the filling step, is cured, the case 4 is refilled with the resin containing no magnetic powder, the resin being resin the composition of which is similar to the resin contained in the mixture, after the filling step has been performed. Here, the resin to be contained in the surface layer 5 is the same as that used for the core coupling portion 32. This facilitates, when the resin is cured later in the curing step, continuous formation of the surface layer 5 and the core coupling portion 32 without the interface formed therebetween. Furthermore, the resin to be contained in the surface layer 5 may be a mixed resin made by mixing the same resin as that used for the core coupling portion 32 and additional particles. When using, for example, ceramic particles having a high thermal conductivity as the additional particles, heat dissipation properties of the surface layer 5 can be improved.

In the present manufacturing method, since there is no need of separating the magnetic powder and the resin from each other to form the surface layer 5 in the leaving-to-stand step, various resins can be selected without limitation of the viscosity. That is, the resin to be contained in the core coupling portion 32 and the resin to be contained in the surface layer 5 may be different from each other or may contain different additives such as curing agents added to the resin. For example, the viscosity of the resin contained in the magnetic mixture to be contained in the core coupling portion 32 and the viscosity of the resin to be contained in the surface layer 5 may be different from each other. As is the case with the present example, when the surface layer 5 and the core coupling portion 32 are separately formed, for example, the viscosity of the resin to be contained in the core coupling portion 32 can be increased because the leaving-to-stand step is not needed. Thus, a situation in which the magnetic powder settles on the bottom surface side and the resin tends to gather on the opening side of the case does not easily occur, and accordingly, the core coupling portion 32 in which the magnetic powder is uniformly distributed is easily obtained, thereby facilitating formation of sufficient magnetic paths. Furthermore, the resin, with which the case 4 is refilled in the refilling step, is not easily mixed with the resin to be contained in the core coupling portion 32. Thus, the surface layer 5 that is substantially free of the magnetic powder is easily formed.

In the refilling step, as described above, the case is refilled with the resin that does not contain the magnetic powder. Thus, the surface layer 5 that is substantially free of the magnetic powder can be more reliably formed in a shorter time. Furthermore, the resin with which the case 4 is filled in the filling step and the resin with which the case is refilled in the refilling step are simultaneously cured in the curing step. Thus, the surface layer 5 and the magnetic core 3 can be simultaneously formed, and the surface layer 5 and the magnetic core 3 can be formed so as to be continuous with each other without the interface formed therebetween.

[Other Step]

As the other step, also in the present manufacturing method, a deaeration process by purging air may be performed in order to eliminate voids in the mixture and in the surface layer 5, or voids formed between the mixture and the surface layer 5. This deaeration process may be performed between the filling step and the refilling step and between the refilling step and the curing step, or performed only between the refilling step and the curing step. The former case is preferable because voids in the mixture and the surface layer 5, and voids formed between the mixture and the surface layer 5 are sufficiently easily eliminated. The latter is preferable because the amount of work is decreased because of fewer deaeration steps.

In either the manufacturing method (I) or the manufacturing method (II), the reactor 1α can be obtained after the resin has been cured. In this reactor 1α, a portion that covers the outer periphery of the coil 2 is substantially formed of the mixture of the magnetic powder and the resin, and a region having a certain thickness from the surface exposed from the opening portion of the case 4 is substantially formed of the resin (the same resin as the resin contained in the core coupling portion).

[Advantageous Operational Effects]

The following advantageous effects are obtained according to the above-described embodiment.

(1) By providing the surface layer, which has the resin portion made of resin similar to the resin contained in the magnetic core, on the surface of the magnetic core on the opening portion of the case side, the magnetic powder is not easily brought into contact with air, and accordingly, the magnetic powder can be prevented from being corroded. Since the surface layer can be formed at the same time as the formation of the magnetic core, the magnetic core and the surface layer are formed so as to be continuous with each other without the interface formed therebetween. For this reason, even when the surface layer is exposed to a heat cycle that occurs due to operation of the reactor, the surface layer is not separated. Accordingly, there is no need of providing a separate covering member corresponding to the lid. In addition, unlike the case where the separate covering member is provided, air does not remain between the covering member and the magnetic core. Thus, corrosion of the magnetic powder caused by contact with air can be suppressed and magnetic characteristics of the magnetic core are not easily degraded.

(2) According to the manufacturing methods described above, the surface layer, which has the resin portion made of resin similar to the resin contained in the magnetic core, can be formed on the surface of the magnetic core on the opening portion of the case side. This surface layer is continuous with the resin of the magnetic core without the interface formed therebetween. The surface layer can be formed at the same time as the formation of the magnetic core.

(3) In the reactor manufactured in the manufacturing method (I), the magnetic core is formed such that the magnetic powder is sparsely distributed on the opening portion of the case side and densely distributed on the bottom surface of the case side. Accordingly, the magnetic powder, which has a high thermal conduction rate, tends to gather on the bottom surface side of the case. Thus, when the bottom surface of the case is mounted on the cooling means, good heat dissipation properties are obtained.

(4) In the reactor manufactured in the manufacturing method (II), before the above-described mixture is cured, the case is refilled in the refilling step with the resin containing no magnetic powder, the resin being resin the composition of which is similar to the resin contained in the mixture, after the filling step has been performed. Thus, the surface layer that is substantially free of the magnetic powder can be more reliably formed in a shorter time.

(5) As described above, the magnetic core can have an adhesiveless structure in which the magnetic core is manufactured without using any adhesive. Since the reactor uses the compact for the internal core portion, the saturation flux density can be easily adjusted and a complex three-dimensional shape can be easily formed. Thus, the reactor can be manufactured with good productivity.

(6) Since the internal core portion has a saturation flux density higher than that of the core coupling portion, in order to obtain the same magnetic flux as that of a magnetic core formed of a single material and having a uniform saturation flux density in the entirety thereof, the sectional area (plane through which the magnetic flux passes) of the internal core portion can be reduced. Furthermore, in the reactor, the saturation flux density of the internal core portion is high and the magnetic permeability of the core coupling portion is low. Thus, a gapless structure that uses no gap member can be realized. When the reactor has a gapless structure, the coil and the internal core portion can be disposed close to each other. Furthermore, since the outer shape of the internal core portion of the reactor is a cylindrical shape conforming to the shape of the inner peripheral surface of the cylindrical coil, the coil and the internal core portion is more easily disposed closer to each other. Thus, the size of the reactor can be reduced.

(7) In addition, since the reactor includes the case, the assembly of the coil and the magnetic core can be protected from the external environment, that is, protected from dust or corrosion and can be mechanically protected. The surface layer can also function as a protective member that protects the magnetic core (core coupling portion) and the coil from the external environment and function as a mechanically protective member.

<<Second Embodiment>>

Figure 3:
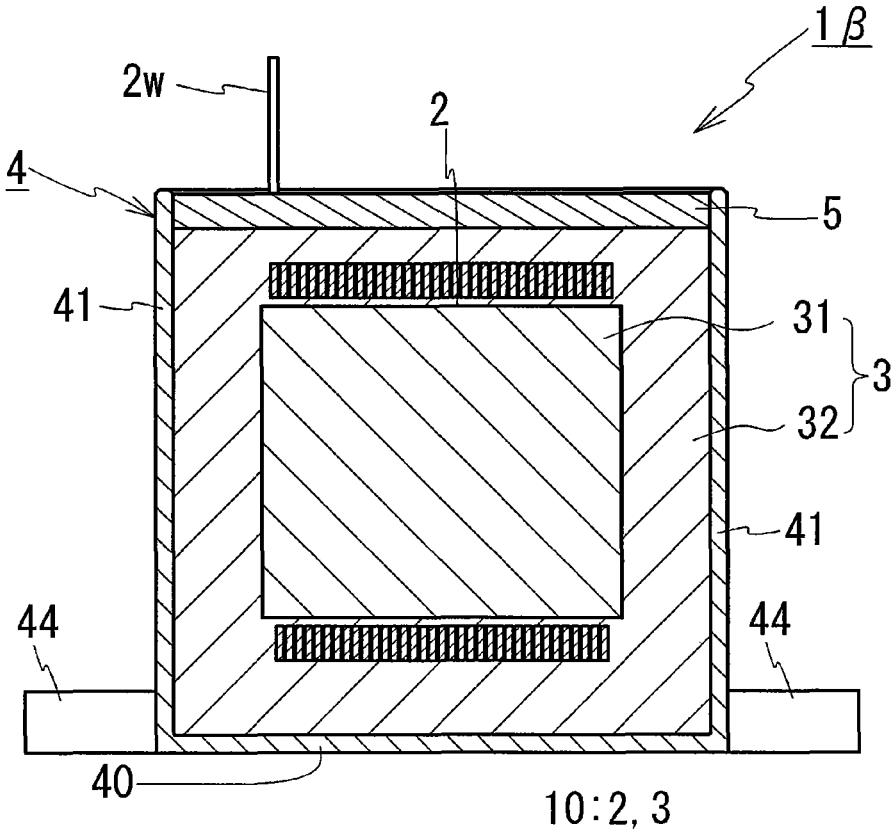
FIG. 3 is a general sectional view of a reactor according to a second embodiment.

As illustrated in FIG. 3, the difference between the first embodiment and a second embodiment is that the coil 2 and the internal core portion 31 is housed in the case 4 such that the axial direction of the coil 2 is parallel to the bottom surface 40 of the case 4 (this form of arrangement is referred to as a horizontal arrangement hereafter). The difference between the first embodiment and the second embodiment is described below.

The magnetic core 3 of a reactor 1β of the present example includes the internal core portion 31 and the core coupling portion 32. The internal core portion 31 is inserted through the coil 2 such that the axial direction thereof is parallel to the bottom surface 40 of the case 4 so that the direction of the internal core portion 31 matches the direction of the coil 2. The combination of the coil 2 and the internal core portion 31 are integrally formed with the outer periphery thereof covered with the core coupling portion 32 such that both the end surfaces of the internal core portion 31 are not brought into contact with the sidewalls 41 of the case. Although the combination appears to float in the core coupling portion 32 in FIG. 3, the combination is actually supported by the case 4 using a coil support portion (not shown). By providing this coil support portion, the coil 2 and the internal core portion 31 are easily positioned. The coil support portion may be formed so as to protrude from the bottom surface 40 of the case 4 toward the opening side of the case 4, support the coil 2 or the internal core portion 31, and position the coil 2 in the height direction relative to the case 4. Alternatively, the coil support portion may be formed so as to protrude from one of the side surfaces (the side surface perpendicular to the page of FIG. 3) of the case 4 toward the coil 2. The coil support portion may be integrally formed with the case 4 or formed separately from the case 4. The raw material of the coil support portion may be the same as that of the case 4 or different from that of the case 4. In the former, heat generated by the coil can also be dissipated from the support portion. In the latter, the coil support portion may be made of a molded solid body formed of, for example, the same material as that of the core coupling portion 32 and have, for example, a block shape. By doing this, the coil support portion can be easily integrated with the core coupling portion 32 when the core coupling portion 32 is formed and the coil support portion can be utilized as magnetic paths.

Similar to the reactor 1α of the first embodiment, the reactor 1β according to the second embodiment can also be easily manufactured in the above-described manufacturing method (I) or (II).

[Advantageous Operational Effects]

The following advantageous effects are obtained according to the above-described embodiment.

(1) Also in the horizontal arrangement as in the present example, by similarly providing the surface layer that covers the core coupling portion and is exposed from the opening side of the case, the magnetic powder can be prevented from being exposed from the resin contained in the core coupling portion and being corroded.

(2) When the reactor is manufactured in the above-described manufacturing method I, the magnetic powder contained in the core coupling portion settles on the bottom surface side of the case and tends to gather on the bottom side of the case. When the reactor is in the horizontal arrangement as in the present example, the mounting area on the bottom surface of the case is larger than that in the above-described vertical arrangement. Thus, by providing the cooling means or the like on the bottom surface, the heat dissipation properties can be further improved.

(3) Since the reactor is in the horizontal arrangement, even when the magnetic powder contained in the core coupling portion tends to gather on the bottom surface side of the case, the magnetic powder easily exists so as to cover both the end portions and the outer periphery of the coil, and accordingly, magnetic paths are easily formed. That is, even when the magnetic powder excessively gathers on the bottom surface of the case, magnetic paths can be formed. Thus, when the magnetic powder excessively gathers on the bottom surface of the case, the surface layer that is substantially free of the magnetic powder is easily formed.

(First Modification)

Figure 4:
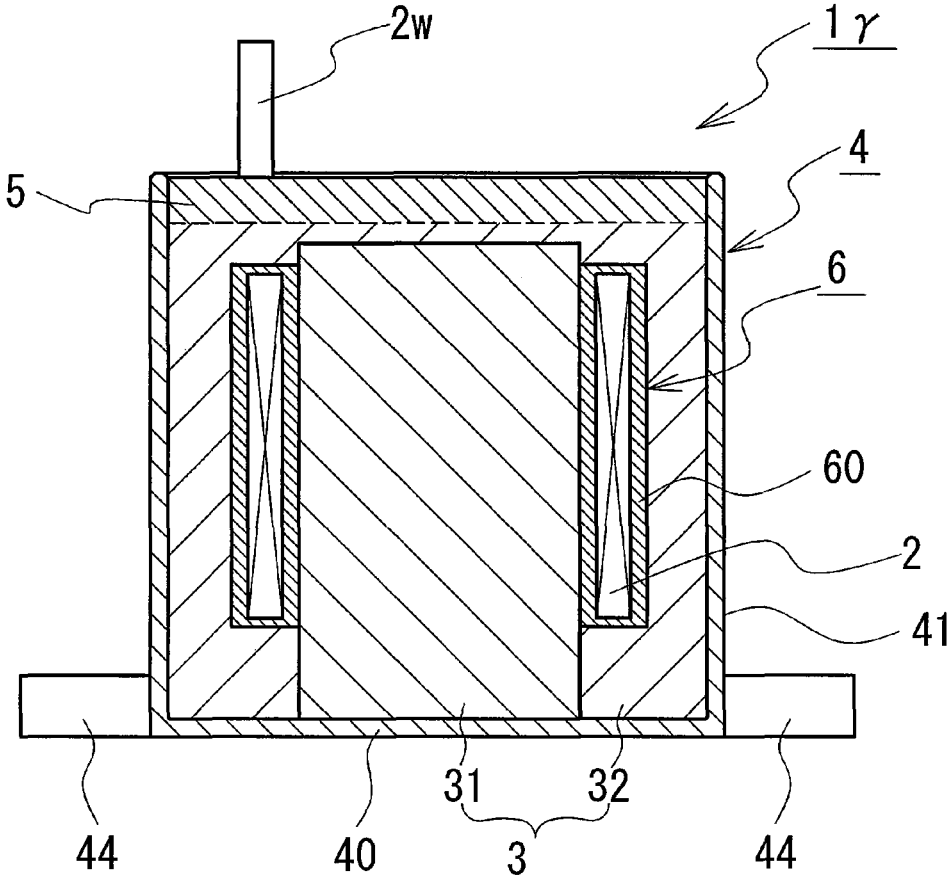
FIG. 4 is a sectional view of a reactor according to a first modification taken along the axial direction of a coil.
Figure 5:
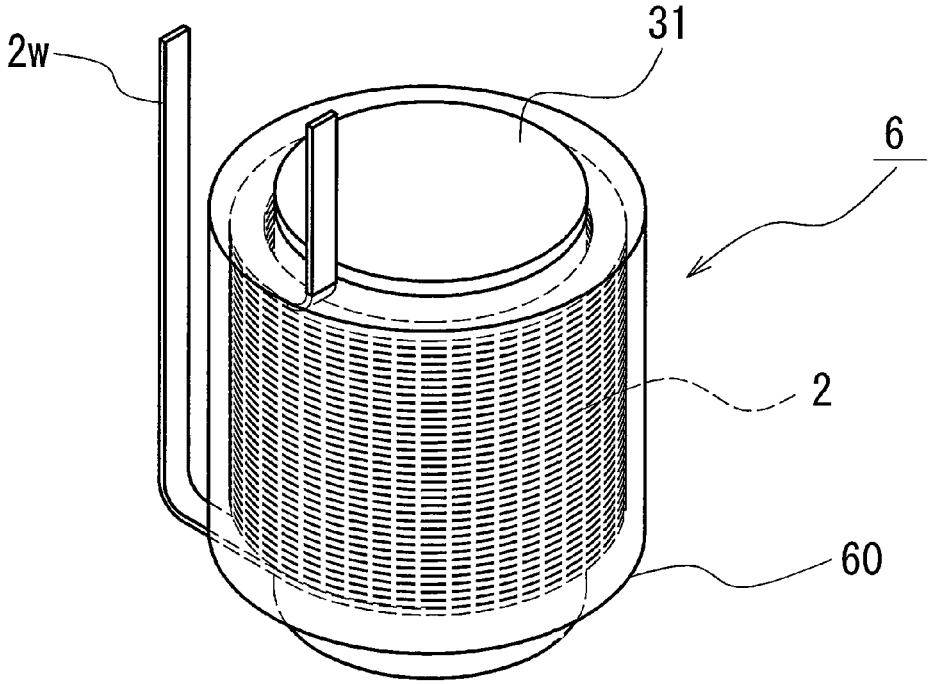
FIG. 5 is a general perspective view of a coil molded product provided in the reactor according to the first modification.

As illustrated in FIGS. 4 and 5, the difference between the first modification and the first and second embodiments is that the first modification includes a coil molded product 6 that includes an internal resin portion 60 covering the surface of the coil 2 as a structure that ensures insulation between the coil 2 and the magnetic core 3. The coil molded product 6, which is the difference between the first modification and the first and second embodiments, is described below. Other than the coil molded product 6, the first modification has the same structure as that of the first and second embodiments, and description of the same structure is omitted.

[Coil Molded Product]

The coil molded product 6 includes, for example, the coil 2, the internal core portion 31, and the internal resin portion 60. The internal core portion 31 is inserted through the coil 2. The internal resin portion 60 covers the surface of the coil 2 so as to hold the shape of the coil 2 and holds the coil 2 and the internal core portion 31 in an integral manner.

Alternatively, the coil molded product may include the coil and the internal resin portion, which covers the surface of the coil so as to hold the shape of the coil. The internal resin portion has a hollow through which the internal core portion is inserted. In this structure, a resin component of the internal resin portion disposed inside the coil can function as a positioning portion that positions the internal core portion when the thickness of the resin component of the internal resin portion is adjusted so that the internal core portion is disposed at an appropriate position in the coil and the shape of the hollow conforms to the external shape of the internal core portion. Thus, the internal core portion can be easily inserted and disposed at a specified position in the coil of the coil molded product.

When a substantially entire portion of the coil 2 except for both the end portions of the wire 2*w* is covered with the internal resin portion 60, the internal resin portion 60 is interposed between the substantially entire periphery of the coil 2 and the magnetic core 3. Thus, insulation between the coil 2 and the magnetic core 3 can be improved. Alternatively, part of a turn formed portion of the coil 2 may be exposed from the internal resin portion 60. In this case, the coil molded product 6 has an irregular external shape, and accordingly, the area in which the coil molded product 6 is in contact with the resin of the core coupling portion 32 is increased. This causes the coil molded product 6 and the core coupling portion 32 to be in tighter contact with each other. When the irregularity of the external shape of the internal resin portion 60 is formed so as not to cause the coil 2 to be exposed, insulation between the coil 2 and the magnetic core 3 can be improved by the internal resin portion 60 interposed therebetween and the state of tight contact is good. The thickness of the internal resin portion 60 is set to, for example, from about 1 to 10 mm.

The resin component of the internal resin portion 60 is preferably formed of an insulating material having the following features: the material is heat resistant to the degree that, when the temperatures of the coil 2 and the magnetic core 3 reach the maximum as a result of operation of the reactor 1γ including the coil molded product 6, the resin component is not softened. In addition, the material can be subjected to transfer molding or injection molding. For example, thermosetting resin such as epoxy resin or thermoplastic resin such as PPS resin or LCP is preferably used. When the component resin uses a mixture, with which a filler formed of at least one ceramic selected from the group consisting of silicon nitride, alumina, aluminum nitride, boron nitride, and silicon carbide, is mixed, heat generated by the coil is easily dissipated and a reactor having a good heat dissipation properties can be obtained. With the internal resin portion, the length of the coil of the coil molded product 6 can be appropriately adjusted by holding the coil in a state compressed from its free length.

The above-described coil molded product 6 can be manufactured by setting the coil 2 and a core, or the coil 2 and the internal core portion 31 in the mold, filling the mold with the resin to be contained in the internal resin portion 60 while the coil 2 is appropriately compressed, and curing the resin. For example, a manufacturing method for a coil molded product described in Japanese Unexamined Patent Application Publication No. 2009-218293 may be used.

[Advantageous Operational Effects]

With such a coil molded product, insulation between the coil and the magnetic core can be improved and the reactor is manufactured with good productivity since the external shape of the coil is more firmly held by the internal resin portion when the reactor is assembled, and accordingly, the coil is easily handled. In particular, when using the coil molded product formed by integrating the coil and the internal core portion with each other using the internal resin portion, the coil and the internal core portion are easily handled because the coil and the internal core portion are not separated and can be set in the case at the same time. Thus, the reactor is manufactured with good productivity. In particular, when using the coil molded product, the internal resin portion of which holds the coil in the compressed state, the length of the coil in the axial direction can be reduced. Thus, the size of the reactor can be further reduced.

It is possible that the embodiments described above are appropriately modified without departing from the gist of the present invention and are not limited to the structures described above.

Industrial Applicability

The reactor according to the present invention can be utilized for a component of a power conversion device such as a bidirectional DC-DC converter installed in a vehicle such as a hybrid automobile, an electric vehicle, or a fuel cell vehicle. The manufacturing method for the reactor according to the present invention can be preferably utilized for manufacturing the reactor according to the present invention.

The invention claimed is:

1. A reactor comprising:

a coil formed by winding a wire;

a magnetic core that is disposed inside and outside of the coil and forms a closed magnetic circuit; and a case that has an opening portion and a bottom surface that opposes the opening portion, an assembly of the coil and the magnetic core being housed in the case, wherein at least the opening portion of the case side of the magnetic core is formed of a molded solid body that contains magnetic powder and resin, wherein a surface layer is provided on a surface of the magnetic core on the opening portion of the case side, the surface layer preventing the magnetic powder from rusting, wherein the surface layer has a resin portion formed of resin similar to the resin contained in the magnetic core, the resin portion being formed so as to be continuous with the resin contained in the magnetic core without an interface formed therebetween, wherein the resin portion of the surface layer and the resin contained in the magnetic core are integrated with each other in tight contact, wherein the molded solid body covers at least part of an outer periphery of the coil, and wherein the magnetic powder contained in the molded solid body is sparsely distributed on the opening portion of the case side and densely distributed on the bottom surface of the case side.

2. The reactor according to claim 1, wherein the resin portion is formed of part of the resin contained in the magnetic core.

3. The reactor according to claim 1, wherein the surface layer is formed of the resin portion that does not contain the magnetic powder.

4. The reactor according to claim 1, wherein the magnetic core has an internal core portion inserted through the coil and a core coupling portion that covers the outer periphery of the coil, is formed of the molded solid body, and is joined to the internal core portion, and wherein the internal core portion and the core coupling portion are integrated with each other by the resin contained in the molded solid body.

5. The reactor according to claim 1, wherein at least part of the resin portion of the surface layer, the part being a part where curing reaction occurs, and at least part of the resin contained in the magnetic core, the part being a part where curing reaction occurs, are superposed each other, and both the resins are combined to each other.

6. The reactor according to claim 1, wherein the thickness of the surface layer is from 0.1 to 5.0 mm.

* * * * *